US006102242A

United States Patent [19]

Jansen

[11] Patent Number: 6,102,242

[45] Date of Patent: Aug. 15, 2000

[54] CAN-LIKE MEMBER FOR DRINKS

[76] Inventor: Josephus Ignatius Matthias Jansen, Emmastraat 12, NL-6591 DW Gennep, Netherlands

[21] Appl. No.: 09/029,506

[22] PCT Filed: Aug. 30, 1996

[86] PCT No.: PCT/NL96/00344

§ 371 Date: May 20, 1998

§ 102(e) Date: May 20, 1998

[87] PCT Pub. No.: WO97/08066

PCT Pub. Date: Mar. 6, 1997

[30] Foreign Application Priority Data

Aug. 31, 1995 [NL] Netherlands ..... 1001111

[51] Int. Cl.[7] ..... B65D 1/20

[52] U.S. Cl. ..... 220/619; 220/608; 220/916; 206/509

[58] Field of Search ..... 220/906, 619, 220/269, 620, 623, 608; 206/509

[56] References Cited

U.S. PATENT DOCUMENTS

| | | | |
|---|---|---|---|
| 2,254,168 | 8/1941 | Dale . | |
| 4,215,792 | 8/1980 | Klein . | |
| 4,262,815 | 4/1981 | Klein . | |
| 4,318,493 | 3/1982 | Jacobsen et al. | 220/269 |
| 4,976,368 | 12/1990 | Klein . | |
| 5,301,830 | 4/1994 | Muller . | |
| 5,346,087 | 9/1994 | Klein . | |
| 5,680,952 | 10/1997 | Chasteen | 220/268 |
| 5,813,561 | 9/1998 | Chang et al. | 220/269 |

FOREIGN PATENT DOCUMENTS 8601488 3/1986 WIPO .

OTHER PUBLICATIONS

Hosford, William F. et al., "The Aluminum Beverage Can", *Scientific American*, Sep. 1994, pp. 34–39.

*Primary Examiner*—Stephen Castellano
*Attorney, Agent, or Firm*—Webb Ziesenheim Logsdon Orkin & Hanson, P.C.

[57] ABSTRACT

A can, in particular a metal can, is provided for drinkable liquids. The can includes a body part having a peripheral wall and base panel and which is connected liquid-tightly on the edge remote from the base to the edge of a cover panel which is provided with a closable aperture having a pouring edge facing toward the wall. At least on the portion between the pouring edge of the aperture and the cover rim, an inward curved surface is arranged to enable placing thereagainst the lower lip of the user.

5 Claims, 4 Drawing Sheets

CAN-LIKE MEMBER FOR DRINKS

BACKGROUND OF THE INVENTION

The invention relates to a can, in particular a metal can, for drinkable liquids, consisting of a body part having a peripheral wall and base panel and which is connected liquid-tightly on the edge remote from the base to the edge of a cover panel which is provided with a closable aperture having a pouring edge facing toward the wall.

Such a can is generally known and described for instance in U.S. Pat. No. 4,262,815. This is usually a two-part can, i.e. a can whereof the can body is manufactured by deep-drawing, for beer or other drinks which may or may not be under overpressure, and a cover panel whereof the peripheral edge is seam-folded to that of the body part, thus resulting in a seamed edge.

The known beer or soft drink can is further provided on the top part with a pouring aperture which is opened by lifting a pull ring resting against the top part, wherein a portion of the top part is pulled loose along a prearranged score line while opening the pouring aperture.

Because of the seamed edge, the consumption of the contents directly from the can is perceived as awkward by users of such a can since the lips do not make good contact with the can rim, whereby part of the liquid can leak out at the sides and can fall for instance onto the clothing of the user.

The object of the invention is to provide a can for drinks which is adapted ergonomically to the mouth, so that the contents thereof can be consumed without the above stated drawbacks.

SUMMARY OF THE INVENTION

This object is achieved according to the invention with a can of the type stated above which is distinguished in that at least on the portion between the pouring edge of the aperture and the cover rim an inward curved surface is arranged to enable placing thereagainst the lower lip of the user.

In a can according to the invention the user, after opening the pouring aperture, can press his lower lip against the curved surface at the position of the pouring aperture and then consume the contents without spillage.

The seamed edge groove is herein no longer filled with liquid, thus contributing to a more hygienic use. Nor can dirt become mixed with the liquid in the groove.

In a further embodiment the curved placing surface extends in a circle and co-axially with the body axis along the peripheral edge of the cover.

In preference the cover panel consisting of the curved surface and the surface with the pouring aperture is arranged recessed such that it extends as far as or close to the plane through the cover rim, whereby the cover panel with the pull tab of the pouring aperture lies in a protected position.

This is particularly important in the case of a group of cans packed in cardboard and stacked on top of one another in storage. The large pressure forces are then transmitted via the edge of the body part and not via the cover panel.

In a further embodiment the base in a can according to the invention has a substantially concave form from outside which is complementary to the form of the cover such that a first such can is stackable in stable manner on a second such can.

In the case of a recessed cover panel, the base panel can therein likewise take a relatively shallow form, which is advantageous in the applying of a protective coating on the inside.

In one embodiment the base panel is provided in an edge zone located close to the transition to the body with a peripheral edge bulging downward such that the bulging peripheral edge of the base of a first can, when stacked on a second can, falls into the upper edge thereof.

The invention will be further elucidated in the following figure description of a number of embodiments with reference to the drawings.

DETAILED DESCRIPTION OF THE PREFERRED EMBODIMENT

Figure 1A:
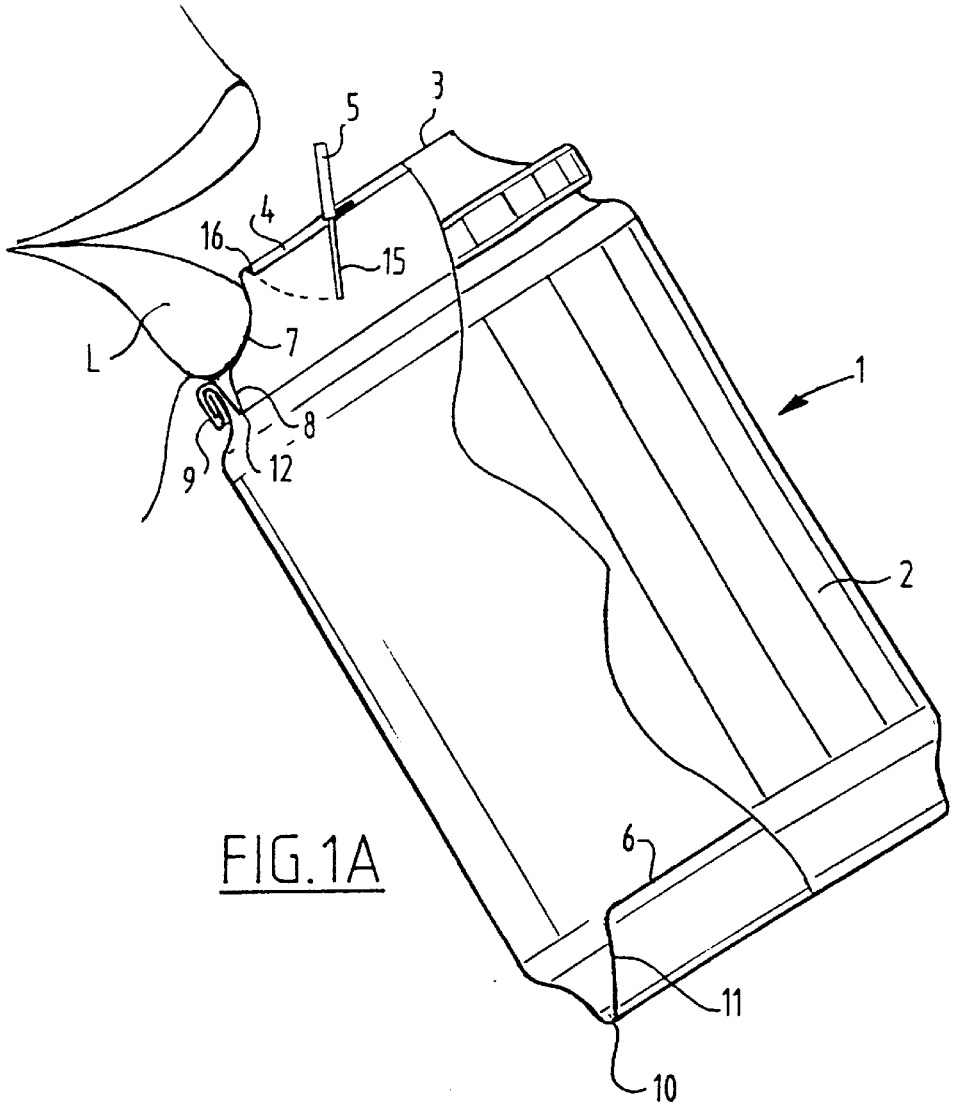
FIG. 1A shows an axial section of a first embodiment of a can for drinks according to the invention in oblique position with the curved surface pressed against the lower lip of a user.

FIG. 1A is a schematic view in axial section of a can 1 for drinks with a cylindrical body 2, a cover panel with an upper surface 3 in which a pouring aperture 4 results after lifting a pull ring 5 and thereby pressing down a portion 15 of the upper surface 3 located inside a scored edge 16, which upper surface 3 transposes into a curved surface 7 which extends as far as an edge zone 8 which in turn adjoins the connection 9 (for instance a per se known double seamed edge, the details of which are not shown) of the cover to the body 2. The base 6 which is substantially concave from the outside is complementary to the form of the cover such that the shown can 1 is easy to stack on an identical second can, wherein a bulge 10 of the first can 1 then falls precisely into the groove 12 formed by the edge zone 8 in the second can (not shown) and falls into the edge 9 formed by the can body 2 of the second can. For further improvement of the stability of cans stacked on one another the concave base 6 transposes in radial direction into a transitional portion 11 which is convex from outside and which has a form complementary with the curved surface of the cover.

FIG. 1A shows that a lower lip L is pressed against the curved surface 7, whereby no liquid can leak out of the drinks can 1 into for instance the groove 12.

Figure 1B:
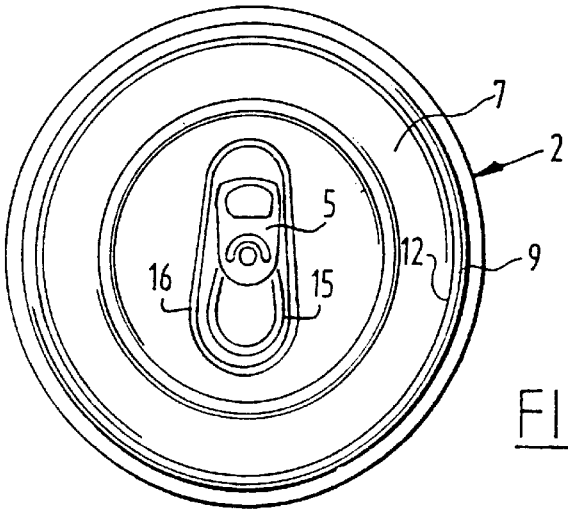
FIG. 1B is a top view of the can of FIG. 1A.

FIG. 1B shows the can of FIG. 1A in top view, wherein corresponding reference numerals refer to corresponding components.

Figure 2:
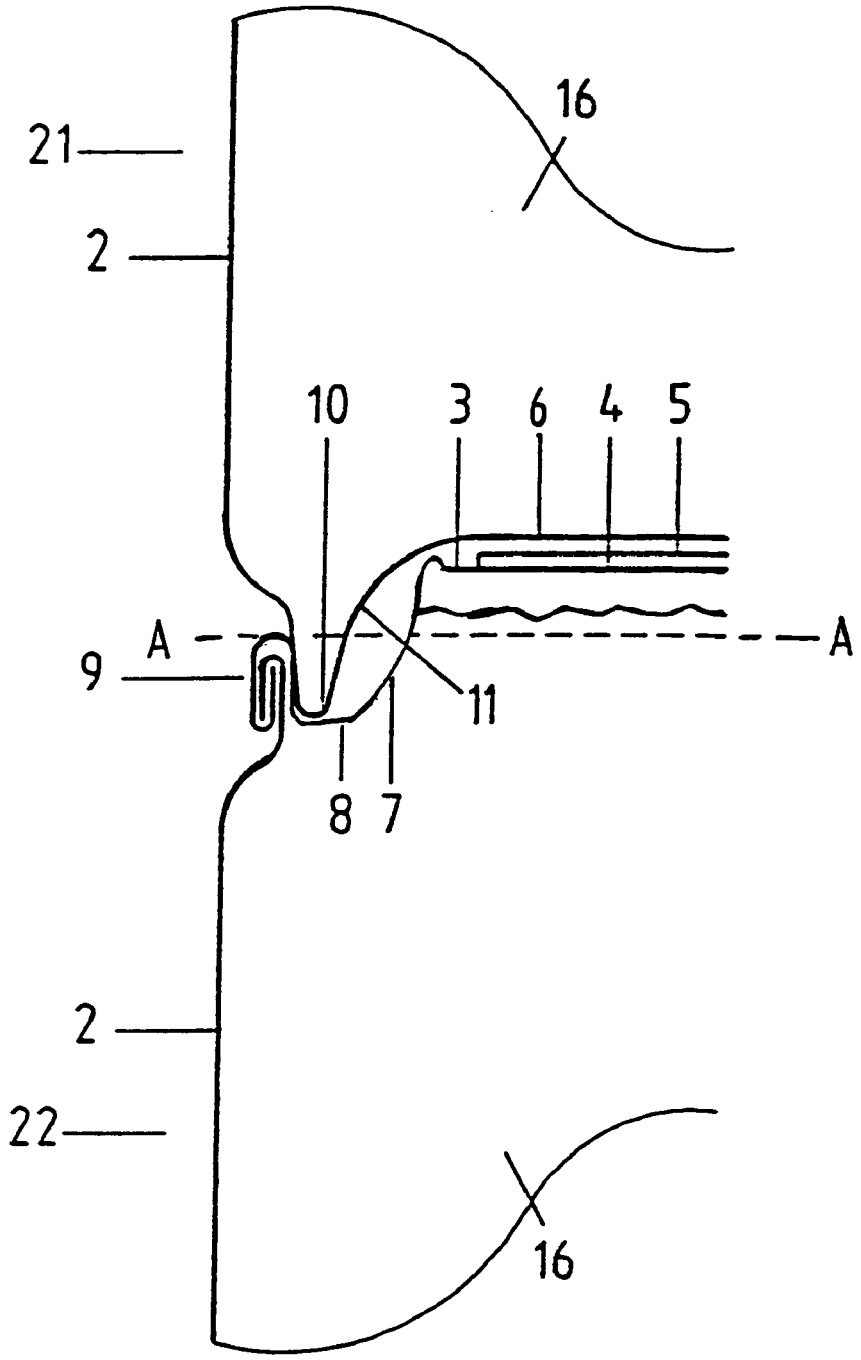
FIG. 2 shows an axial section of parts of two drinks cans according to a second embodiment of the invention stacked on top of one another.

FIG. 2 is an axial section of parts of a first drinks can 21 according to another embodiment of the invention stacked on an identical, unopened second can 22. Reference numerals corresponding with reference numerals in FIG. 1A and 1B designate corresponding components, with the understanding that the edge zone 8 of the cover forms a continuation of the curved surface of the cover, wherein the surface 7 extends substantially above the level A—A of the body 2 of the can 22. The narrow groove 12 is not present here.

It is noted that in the FIG. 1–2 the can is provided with a cover panel which protrudes above the plane through the upper part of the peripheral edge respectively the seamed edge on the top side of body part 2. This automatically provides a recessed base panel 6 for better stacking, which in some applications may be problematic for the inner coating of the can.

FIG. 3A, 3B, 4 and 5 show an embodiment wherein the base panel does not protrude above the relevant plane AA.

Figure 3A:
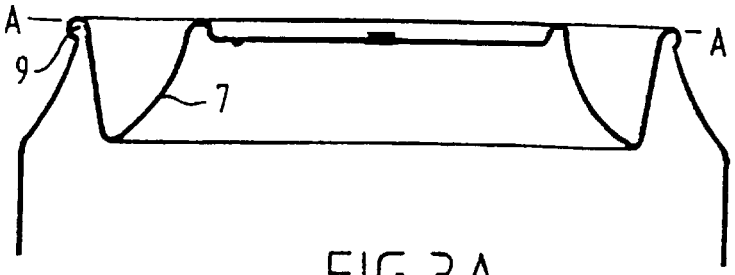
FIG. 3A and 3B each show an axial section of the upper edge or cover panel of a drinks can according to two alternative embodiments.

In FIG. 3A the upper surface of the cover is arranged parallel to the plane A—A, wherein the curved surface 7 remains at a distance from the folded seam 9. The thus created space is sufficient to allow placing thereagainst of the lower lip L of the user, thus preventing the above mentioned drawback of leakage.

Figure 3B:
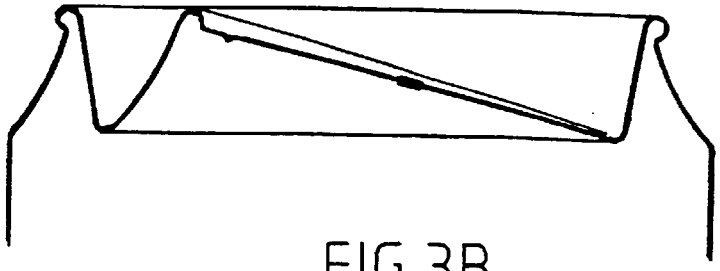
Figure 4:
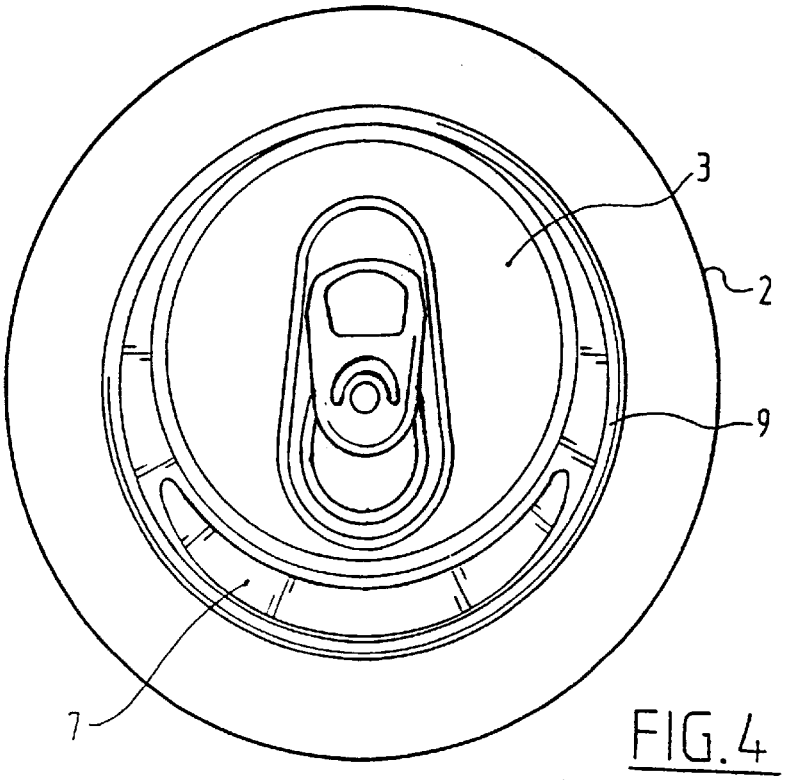
FIG. 4 is a top view of the cover panel of FIG. 3B.

FIG. 3B shows an embodiment wherein the upper surface does not run parallel to the plane A—A, but is located thereunder. The curved surface 7 does not extend over the whole periphery to form an annular shape as in FIG. 3A but is only present along a portion of the periphery, see also FIG. 4. The same advantage of nonleakage of liquid during drinking is retained with this embodiment. In all embodiments the further advantage is retained that, both in the case of the groove 12 of FIG. 1 and in the case of the wider grooves in FIG. 3 and 4, no liquid can intermix with dirt which may have accumulated in the groove. There is hereby no danger of infection for the user.

Figure 5:
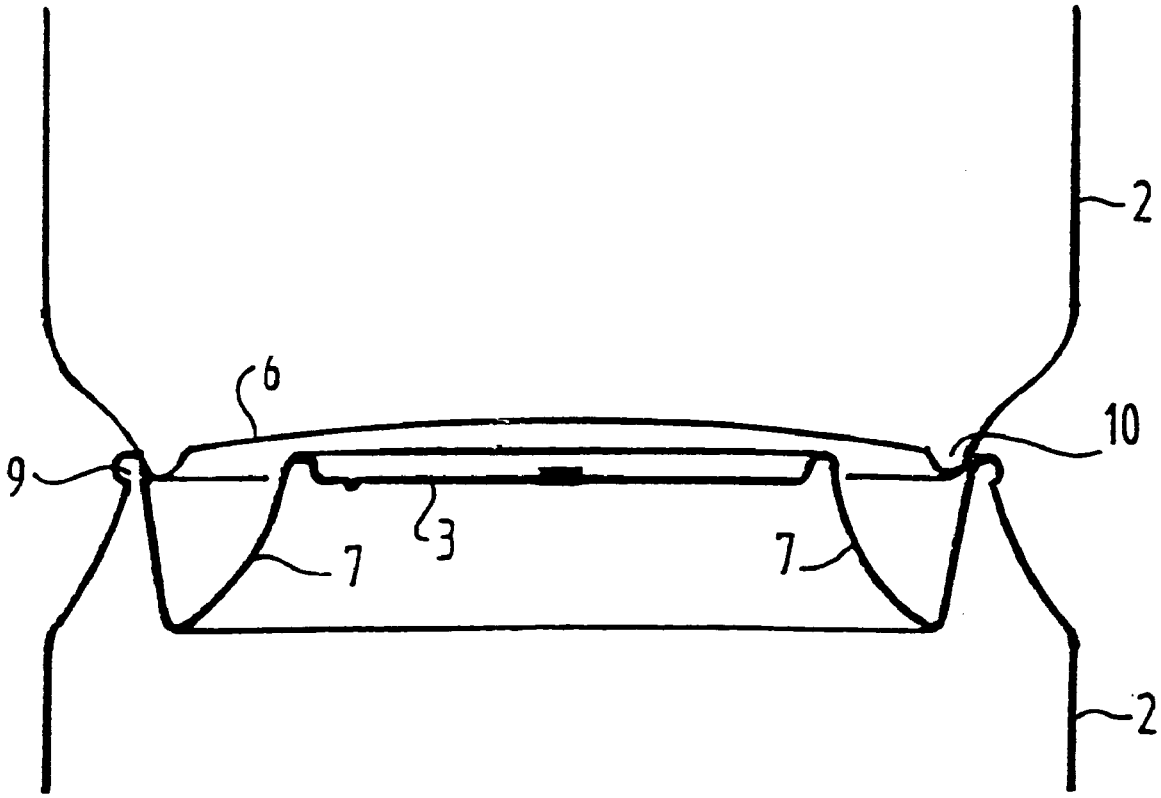
FIG. 5 is an axial section corresponding with FIG. 2 of two cans in the embodiment of FIG. 3A stacked on top of one another.

FIG. 5 shows that the base panel 6 can take a relatively flat form, i.e. does not lie so deeply recessed compared to that of FIG. 1, that the shape of the body part can be better covered with a protective layer (coating) which can be applied in accordance with the known art.

The stackability is ensured in that the base is provided with a bulge 10 which falls into the seamed edge 9 of the underlying can.

The invention is not limited to the above described embodiments. The body part drawn as being circular may also take an oval, triangular or square form in cross section, with or without rounded corners and the position and the method of opening the cover panel portion for tearing loose to form the aperture can also be embodied in any suitable manner.

What is claimed is:

1. A can for drinkable liquids comprising:

a body part having a peripheral wall, a base panel and a body part edge remote from the base panel; and a cover panel having a cover panel edge, an upper surface bordered by a bead, and a lever operated push-in tab in an aperture having a pouring edge, wherein the pouring edge faces toward the peripheral wall near the bead and has a smaller curvature than the bead;

wherein the body part is sealed liquid tightly on the body part edge to the cover panel edge;

wherein an inwardly curved surface is arranged at least on a portion of the cover panel between the pouring edge of the aperture and a cover rim to enable a lower lip of a user to be placed thereagainst;

wherein the cover panel including a curved surface and a surface with the pouring aperture is recessed such that it defines a plane extending through or below another plane defined by the cover rim; and wherein the seal between the cover panel edge and the body part edge is formed by a seam.

2. The can as claimed in claim 1 wherein the curved surface extends in a circle and co-axially with a body axis along a peripheral edge of the cover.

3. The can as claimed in claim 1 wherein the base panel has a form adapted to the cover panel in order to obtain a stackable can.

4. The can as claimed in claim 1 wherein the body and the base panel are obtained in accordance with the deep-drawing process.

5. A can for drinkable liquids comprising:

a body part having a peripheral wall, a base panel and a body part edge remote from the base panel; and a cover panel having a cover panel edge, an upper surface bordered by a bead, and a lever operated push-in tab in an aperture having a pouring edge, wherein the pouring edge faces toward the peripheral wall near the bead and has a smaller curvature than the bead;

wherein the body part is sealed liquid tightly on the body part edge to the cover panel edge;

wherein an inwardly curved surface is arranged at least on a portion of the cover panel between the pouring edge of the aperture and a cover rim to enable a lower lip of a user to be placed thereagainst;

wherein the cover panel upper surface is inclined with respect to a longitudinal axis of the can; and wherein the seal between the cover panel edge and the body part edge is formed by a seam.

* * * * *